US007705785B2

(12) United States Patent
Lee et al.

(10) Patent No.: US 7,705,785 B2
(45) Date of Patent: Apr. 27, 2010

(54) ANTENNA PATCH ARRAYS INTEGRALLY FORMED WITH A NETWORK THEREOF

(75) Inventors: Kuan-Wei Lee, Hsin-Tien (TW); Tsung-Wen Chiu, Hsin-Tien (TW); Fu-Ren Hsiao, Hsin-Tien (TW); Po-Sheng Chen, Hsin-Tien (TW); Chih-Ren Hsiao, Hsin-Tien (TW)

(73) Assignee: Advanced Connectek Inc., Hsin-Tien, Taipei Hsien (TW)

( * ) Notice: Subject to any disclaimer, the term of this patent is extended or adjusted under 35 U.S.C. 154(b) by 82 days.

(21) Appl. No.: 12/189,056

(22) Filed: Aug. 8, 2008

(65) Prior Publication Data

US 2008/0309561 A1 Dec. 18, 2008

Related U.S. Application Data

(63) Continuation-in-part of application No. 11/470,592, filed on Sep. 6, 2006, now abandoned.

(30) Foreign Application Priority Data

Dec. 23, 2005 (TW) ..... 94222497 U

(51) Int. Cl.
*H01Q 1/38* (2006.01)

(52) U.S. Cl. ..... 343/700 MS; 343/853

(58) Field of Classification Search ..... 343/700 MS, 343/853

See application file for complete search history.

(56) References Cited

U.S. PATENT DOCUMENTS

| | | | | |
|---|---|---|---|---|
| 6,326,920 | B1 | 12/2001 | Barnett et al. | |
| 6,735,849 | B2 * | 5/2004 | Cheng et al. | 29/600 |
| 6,831,608 | B2 | 12/2004 | Arvidsson | |
| 7,363,058 | B2 * | 4/2008 | Gustaf | 455/562.1 |
| 2007/0146208 | A1 * | 6/2007 | Lee et al. | 343/700 MS |

* cited by examiner

*Primary Examiner*—Tan Ho
(74) *Attorney, Agent, or Firm*—patenttm.us

(57) ABSTRACT

An antenna has a plurality of metallic patches and a feed network both being spaced apart from a ground plate at different levels to obtain better radiation pattern and gain effects. Each of the metallic patches has a body with an outer edge from which an inclined wing extends upwardly and outwardly. Furthermore, the metallic patches and the feed network are integrally formed by bending a single piece of metal plate, thus the antenna improves the design flexibility and also simplifies the production process.

10 Claims, 10 Drawing Sheets

| Model No. | Freq(MHz) | Peak Gain(dBi) | Peak angle | Avg. Gain(dBi) | Source Polar |
|---|---|---|---|---|---|
| 0511-16dBi-2 | 3300.00 | 15.98 | 179.11 | 4.48 | Ver. |

| Model No. | Freq(MHz) | Peak Gain(dBi) | Peak angle | Avg. Gain(dBi) | Source Polar |
|---|---|---|---|---|---|
| 0511-16dBi-2 | 3400.00 | 15.91 | 180.00 | 4.52 | Ver. |

| Model No. | Freq(MHz) | Peak Gain(dBi) | Peak angle | Avg. Gain(dBi) | Source Polar |
|---|---|---|---|---|---|
| 0511-16dBi-2 | 3500.00 | 15.82 | 178.24 | 4.49 | Ver. |

| Model No. | Freq(MHz) | Peak Gain(dBi) | Peak angle | Avg. Gain(dBi) | Source Polar |
|---|---|---|---|---|---|
| 0511-16dBi-2 | 3600.00 | 15.94 | 178.24 | 4.42 | Ver. |

| Model No. | Freq(MHz) | Peak Gain(dBi) | Peak angle | Avg. Gain(dBi) | Source Polar |
|---|---|---|---|---|---|
| 0511-16dBi-2 | 3700.00 | 15.77 | 179.11 | 3.85 | Ver. |

| Model No. | Freq(MHz) | Peak Gain(dBi) | Peak angle | Avg. Gain(dBi) | Source Polar |
|---|---|---|---|---|---|
| 0511-16dBi-2 | 3800.00 | 15.25 | 180.00 | 3.22 | Ver. |

ANTENNA PATCH ARRAYS INTEGRALLY FORMED WITH A NETWORK THEREOF

CROSS-REFERENCE TO RELATED APPLICATIONS

This is a continuation-in-part application of the copending U.S. patent application Ser. No. 11/470,592, which was filed on Sep. 6, 2006.

BACKGROUND OF THE INVENTION

1. Field of the Invention

The present invention relates to an antenna having patch arrays, and more particularly to an antenna having patch arrays integrally formed with a network thereof.

2. Description of Related Art

With the fast development of the wireless communication, the demands for various antennas with different properties or features are increasing. The conventional microstrip antenna is formed by mounting thin metallic patches on a substrate with a ground plate on an opposite side thereof, usually using a feed network cable or a coaxial probe to feed signals. The above metallic patches are usually thin foils with regular shapes, which maybe in shapes of a rectangle, a circle or an ellipse etc. The microstrip antenna can also utilize the metallic patches to form an array structure according to a certain regular arrangement. The pattern of a single metallic patch is difficult to control, and the gain is not high. Therefore array style is used to meet the required conditions. The technique principles of antennas are well known to the industry, so they are not described here any more.

At the present market, the microstrip antenna generally comprises a ground plate, an SIMO (single in multiple out) feed network and at least a pair of metallic patches. The feed network may be composed of multiple paths with different lengths being connected electrically with the metallic patches respectively along different transmitting directions. When electromagnetic signals are input from a signal recourse, the electromagnetic signals will be feed to each of the metallic patches through the feed network. Since the paths of the feed network have different lengths and transmitting directions, it would result in phase differences and also produce interference. The signals can be radiated out to achieve the objects and effects needed by the antenna.

Based on the fabricating and assembling techniques, the conventional array antennas may be categorized to three types.

Type A: The feed network and the metallic patches are individually manufactured and then respectively mounted on the opposite surfaces of the ground plate.

Type B: The feed network and the metallic patches are individually manufactured, mounted on the same surface of the ground plate and located at different altitudes.

Type C: The metallic patches and the feed network in the form of microstrip cable are individually manufactured and integrated on a PCB.

Since the feed network and the metallic patches are individually produced, assembling them to the ground plate respectively would result in higher complexity and obvious interference. Further, the foregoing type C also makes the microstrip increases partial loss, and deteriorates the radiation properties including the gain and the sidelobe level.

With reference to U.S. Pat. No. 6,326,920, Barnett discloses an antenna comprising a ground plate, a feed network and multiple metallic patches in pairs integrally connected to the feed network. However, the flat configuration of each metallic patch may cause the sidelobe and energy dissipation problem.

SUMMARY OF THE INVENTION

The primary object of the present invention is to provide an antenna, in which metallic patches and a feed network are integrally formed to simplify the production of the antenna, and each of the metallic patches extends an inclined wing to mitigate the sidelobe problem.

The antenna of the present invention comprises a plurality of metallic patches and a feed network both being spaced apart from a ground plate at different levels to obtain better radiation pattern and gain effects. Each of the metallic patches has a body with an outer edge from which an inclined wing extends upwardly and outwardly. Furthermore, the metallic patches and the feed network are integrally formed by bending a single piece of metal plate, thus the antenna improves the design flexibility and also simplifies the production process.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
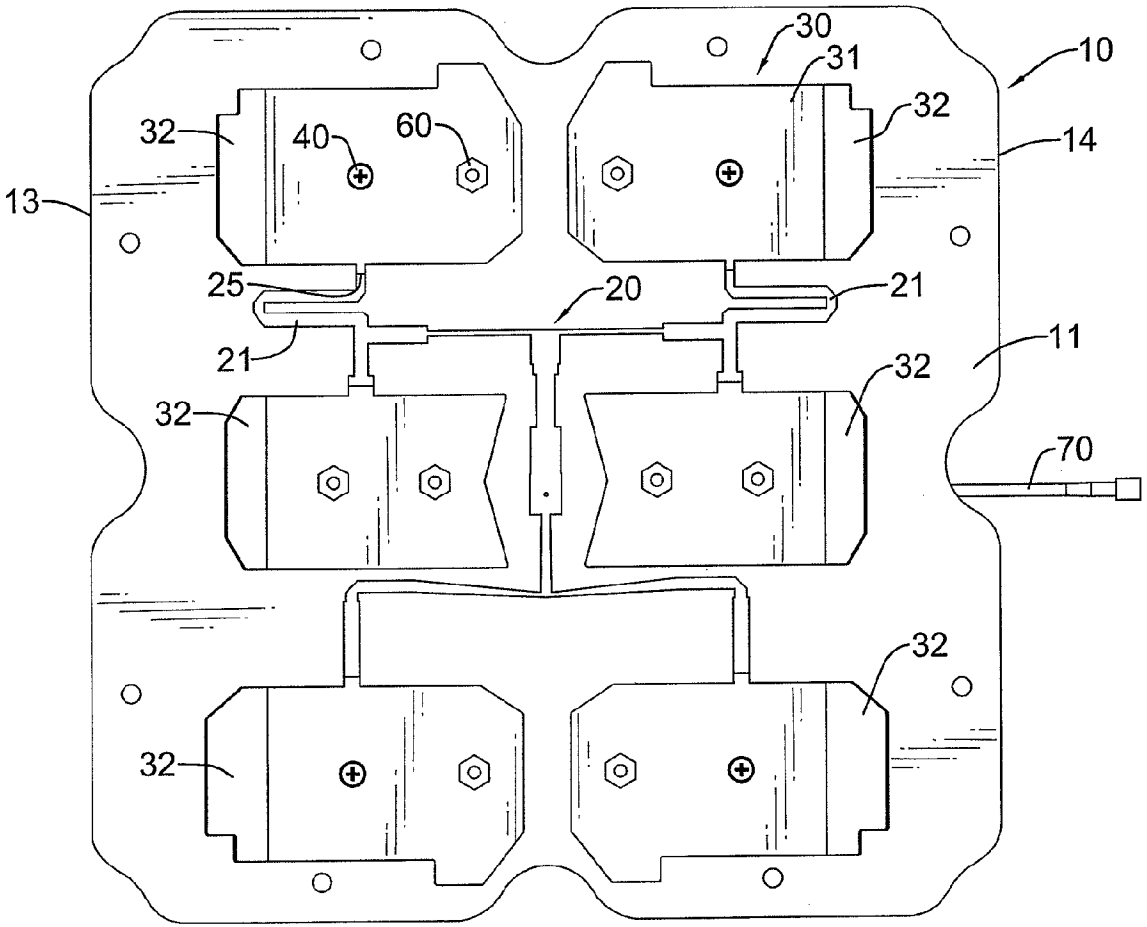
FIG. 1 is a top view of an antenna in accordance with the present invention.
Figure 2:
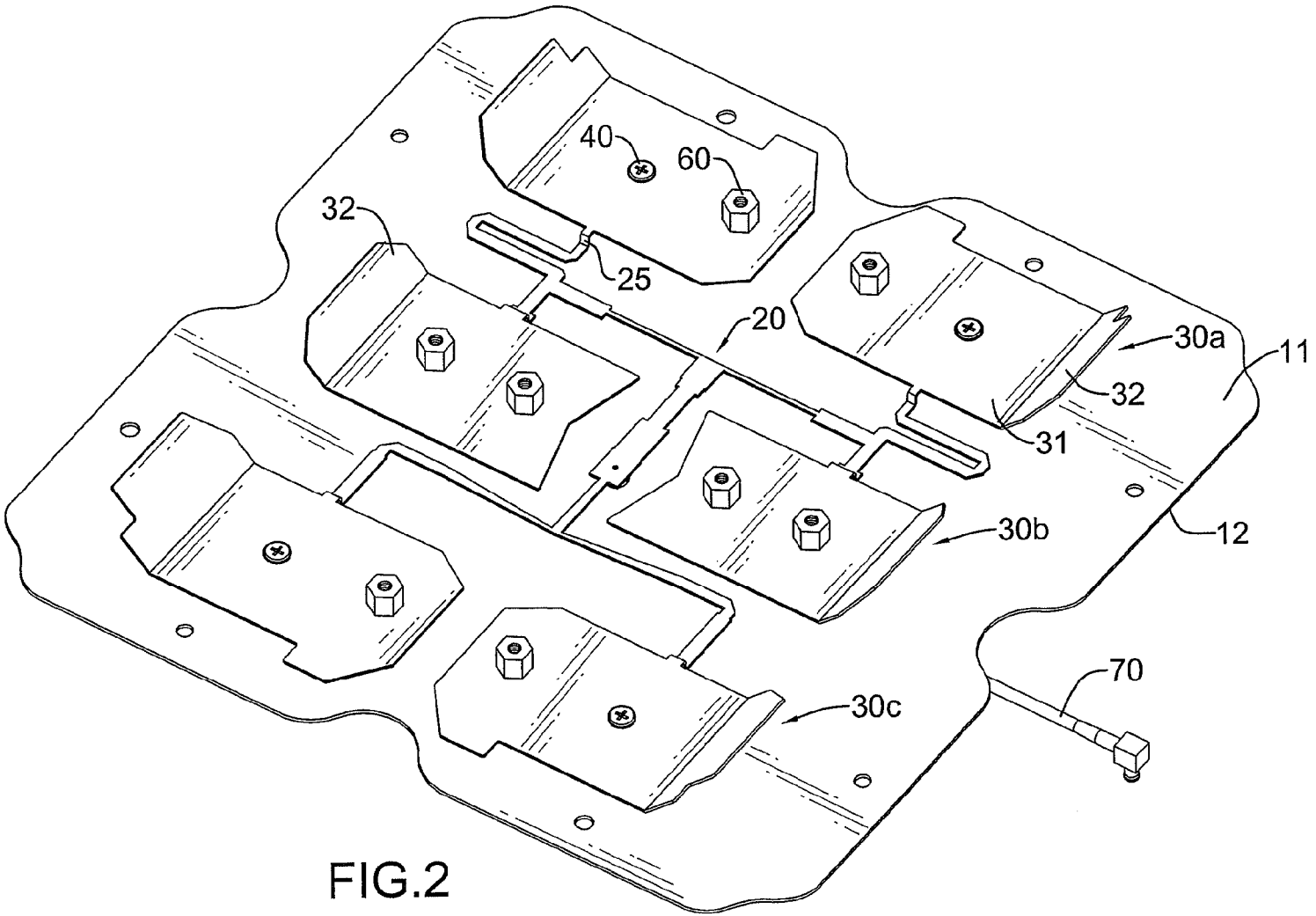
FIG. 2 is a perspective view of the antenna of FIG. 1.

With reference to FIGS. 1 and 2, an antenna according to a preferred embodiment of the present invention is proposed. The antenna comprises a ground plate 10, a feed network 20, a plurality of metallic patches 30, multiple conductive screws 40, conductive fixing posts 50, insulated supporting posts 60 and a feed coaxial cable 70.

The ground plate 10 is made of conductive material and has a top surface 11, a bottom surface 12 and two opposite edges 13, 14.

The plurality of metallic patches 30 includes but not limited to three groups of symmetrical metallic patches 30. The metallic patches 30 are named as a first metallic patch group 30*a*, a second metallic patch group 30*b* and a third metallic patch group 30*c* respectively. These metallic patch groups 30*a*, 30*b* and 30*c* are arranged in array that is symmetrical in left and right. Each of the metallic patch 30 has a substantially rectangular body 31 with an outer edge from which an inclined wing 32 extend outwardly and upwardly toward the edge 13, 14 of the ground plate 10. In other words, the two inclined wings 31 of the metallic patches 30 in pairs outwardly extend toward the opposite edges 13, 14 of the ground plate 10 respectively. Preferably, taking the ground plate 10 as a basis (0 degree), the angle between the inclined wing 32 and the ground plate 10 may be within a range from 45 to 90 degrees to ensure that the antenna has superior radiation characteristics. With these inclined wings 31, the radiation energy of the metallic patches 30 can be more concentrated to avoid sidelobe problem and to increase the radiation gain of the antenna.

The feed network 20 are located above the top surface 11 of the ground plate 10 and interconnected among the metallic patches 30. The overlooking projection arrangements of the metallic patches 30 and the feed network 20, the feed network 20 comprises multiple paths with different lengths widths that extend along different directions based on the characteristic requirements of the antenna.

Figure 3:
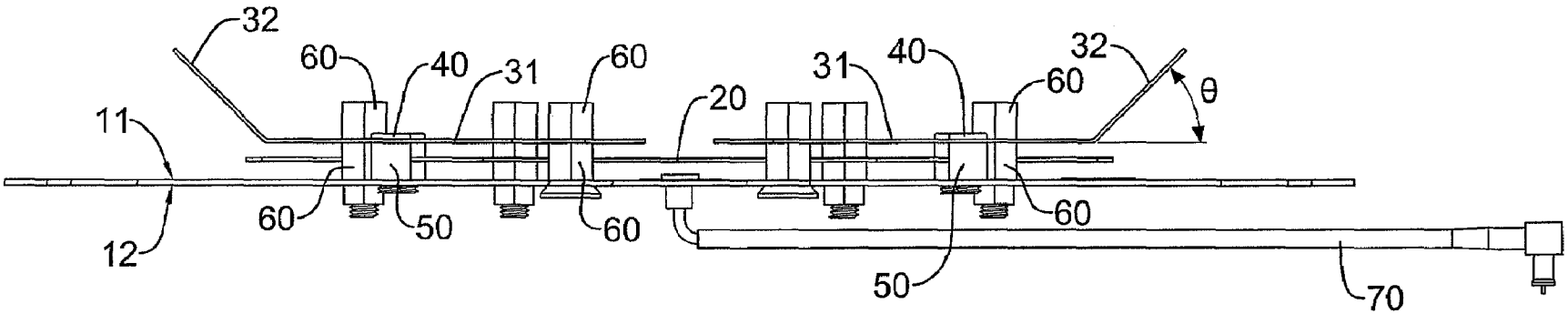
FIG. 3 is a side view of the antenna of FIG. 1.
Figure 4:
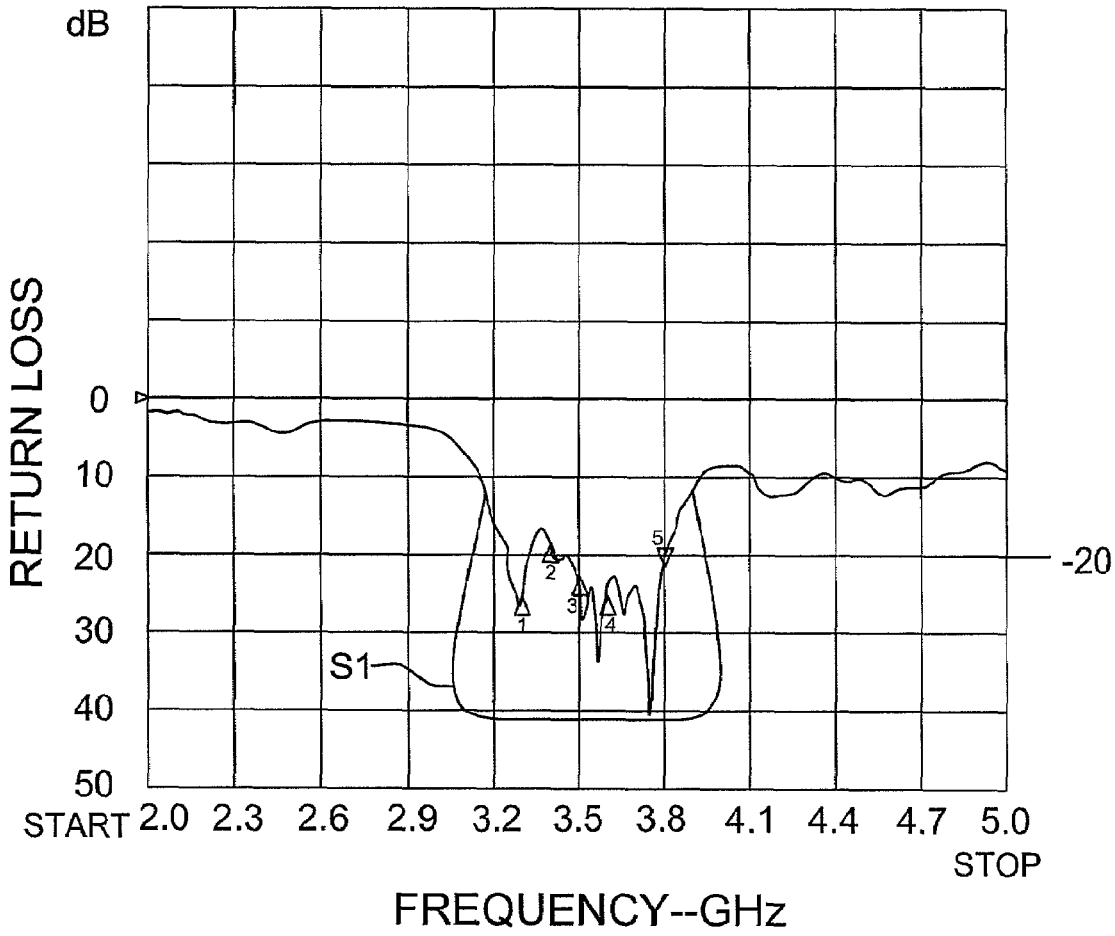
FIG. 4 shows the return loss of the antenna in accordance with the present invention.
Figure 5A:
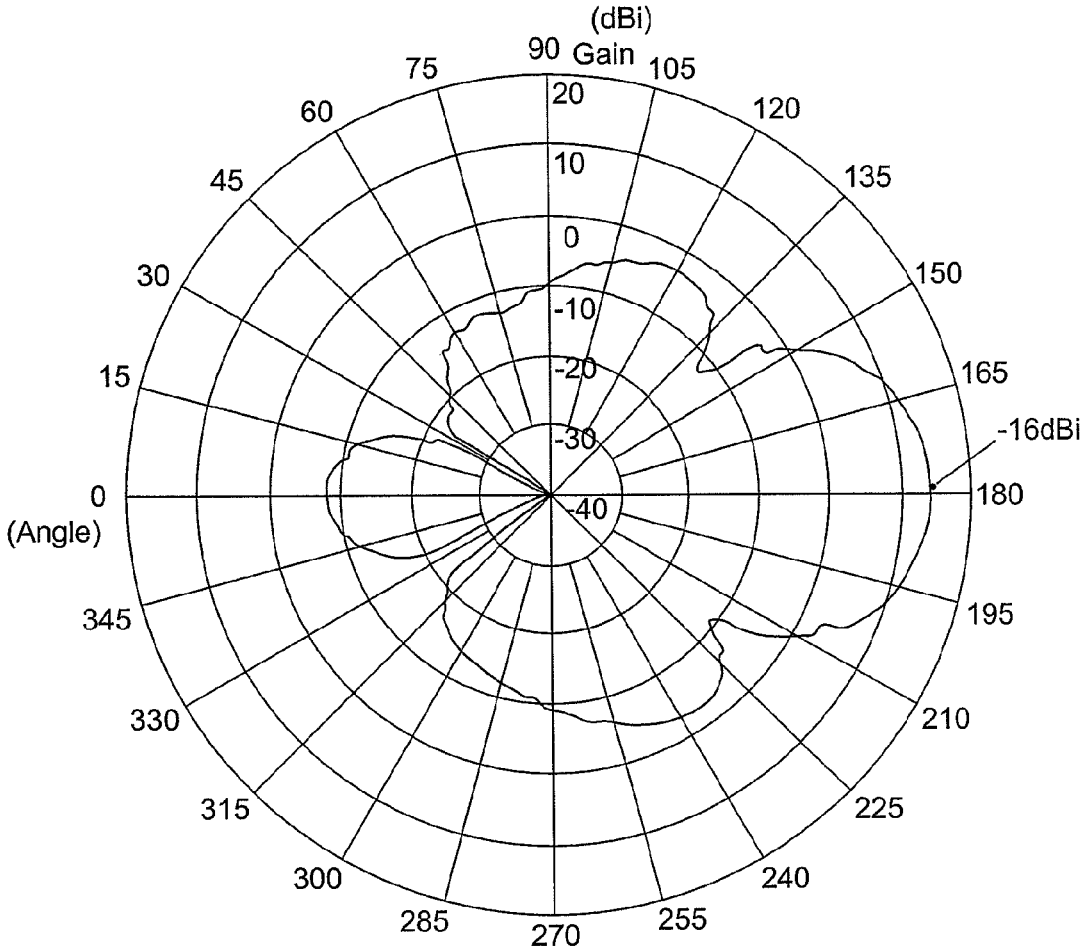
FIGS. 5A-5F show the radiation patterns of the antenna being operated at different frequencies in accordance with the present invention.
Figure 5B:
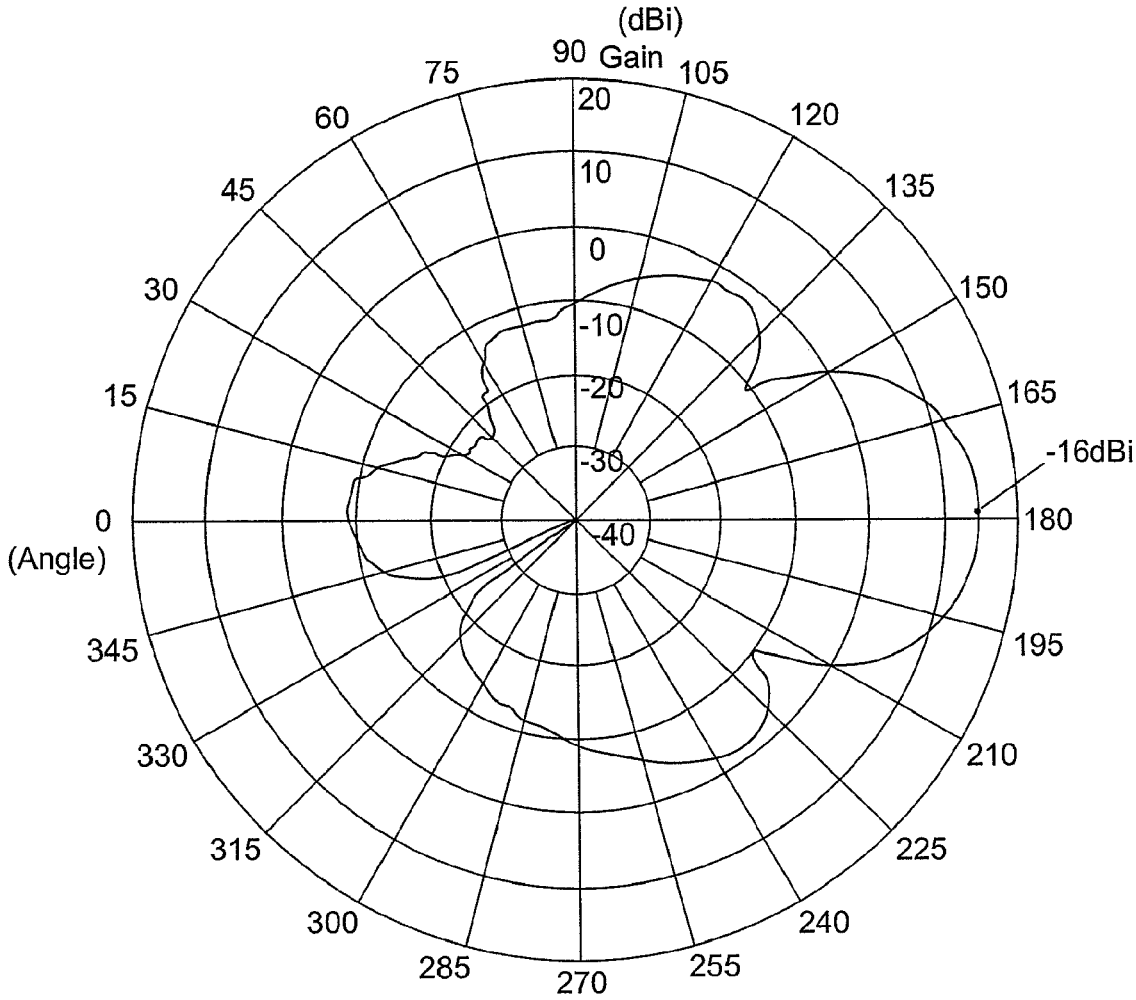
Figure 5C:
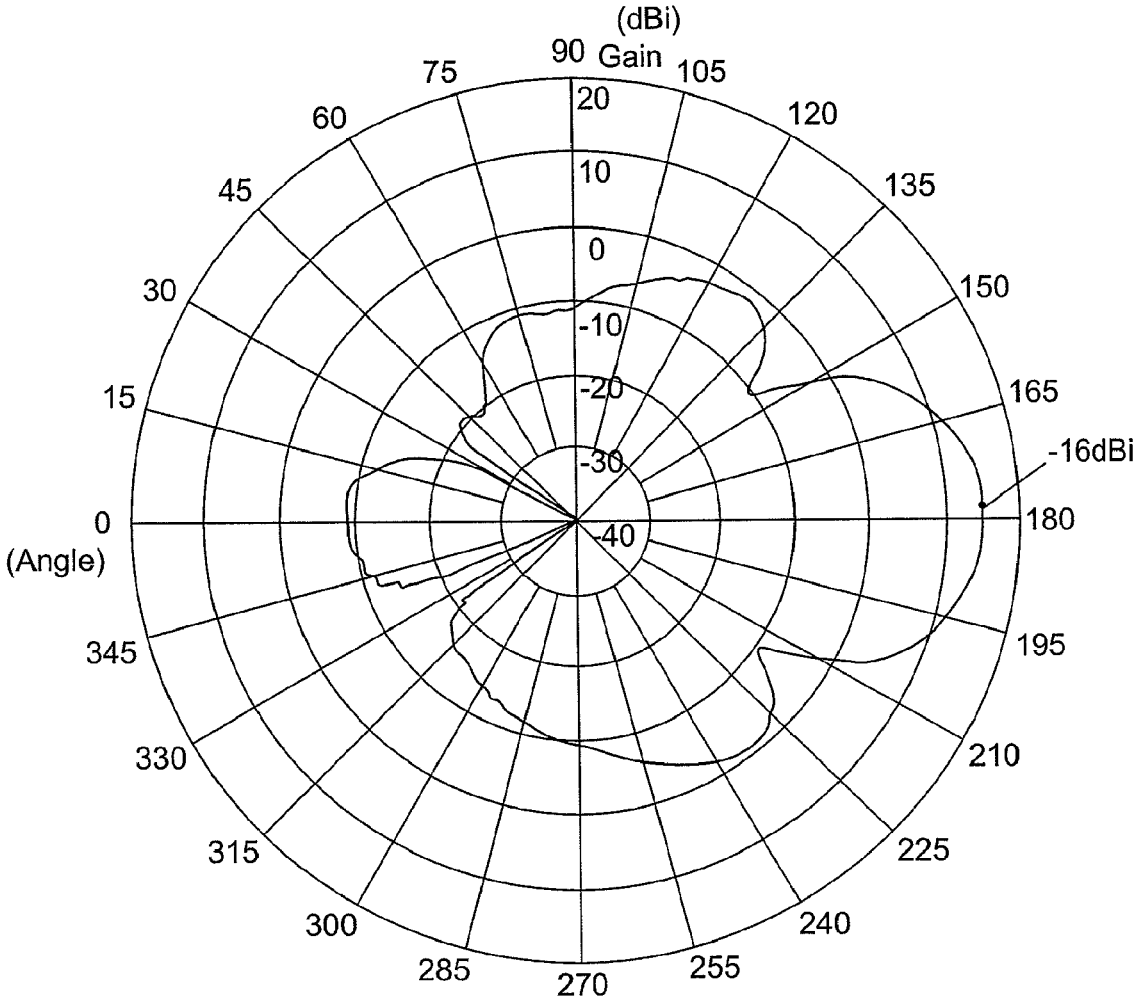
Figure 5D:
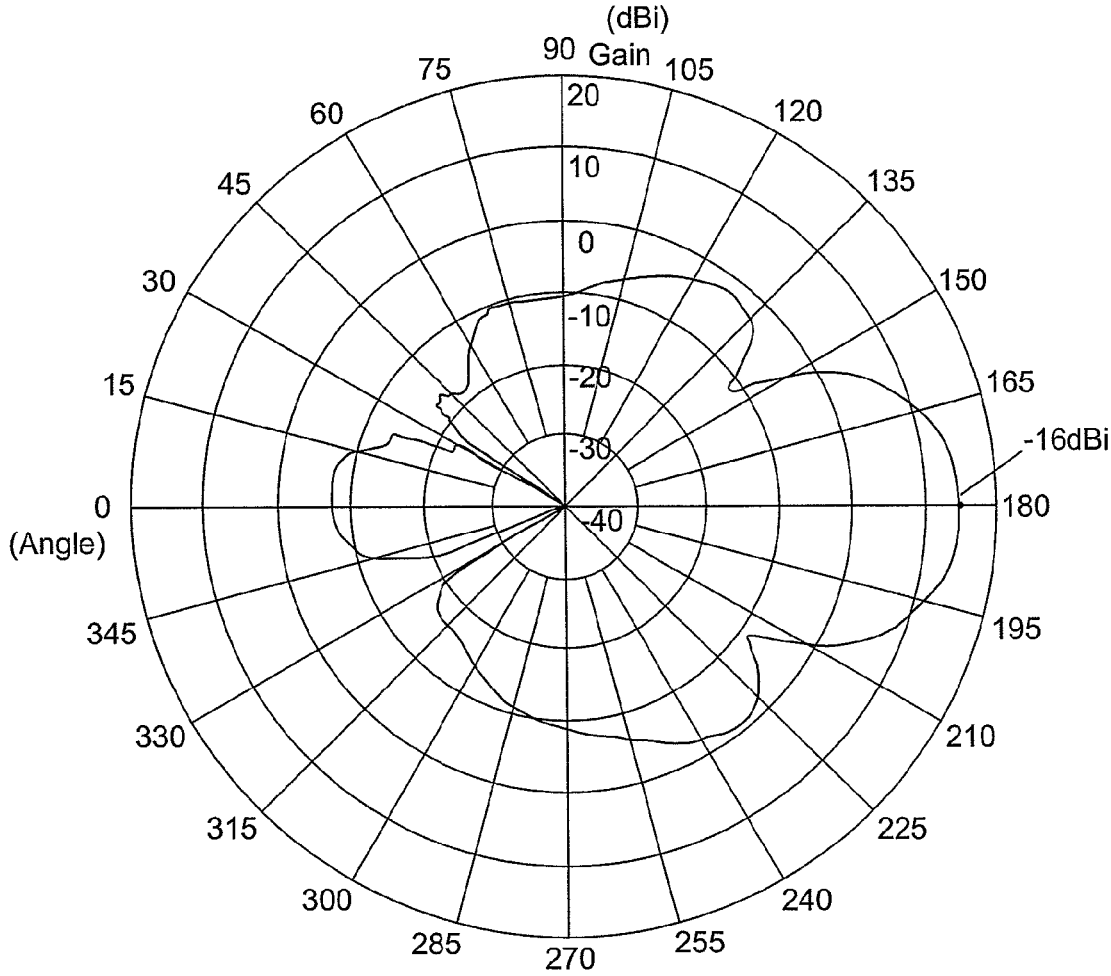
Figure 5E:
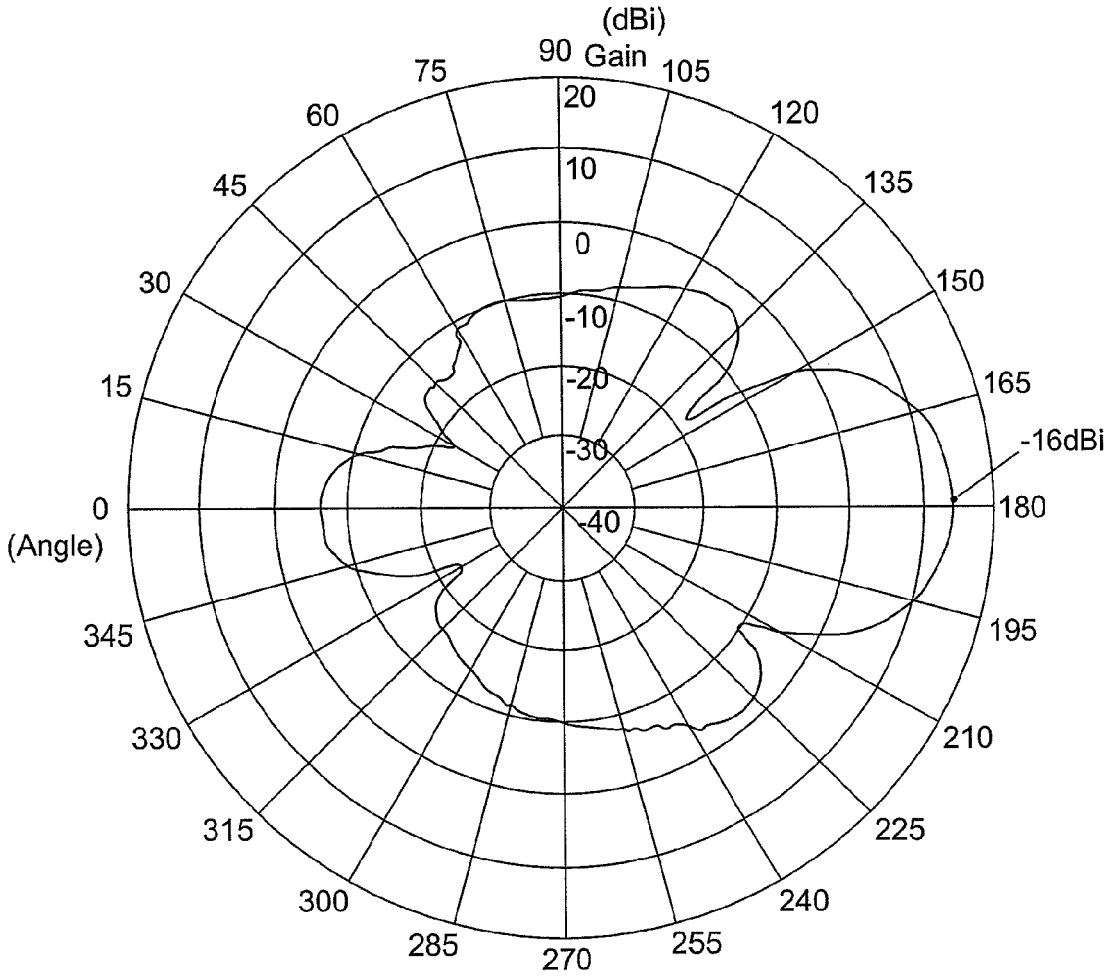
Figure 5F:
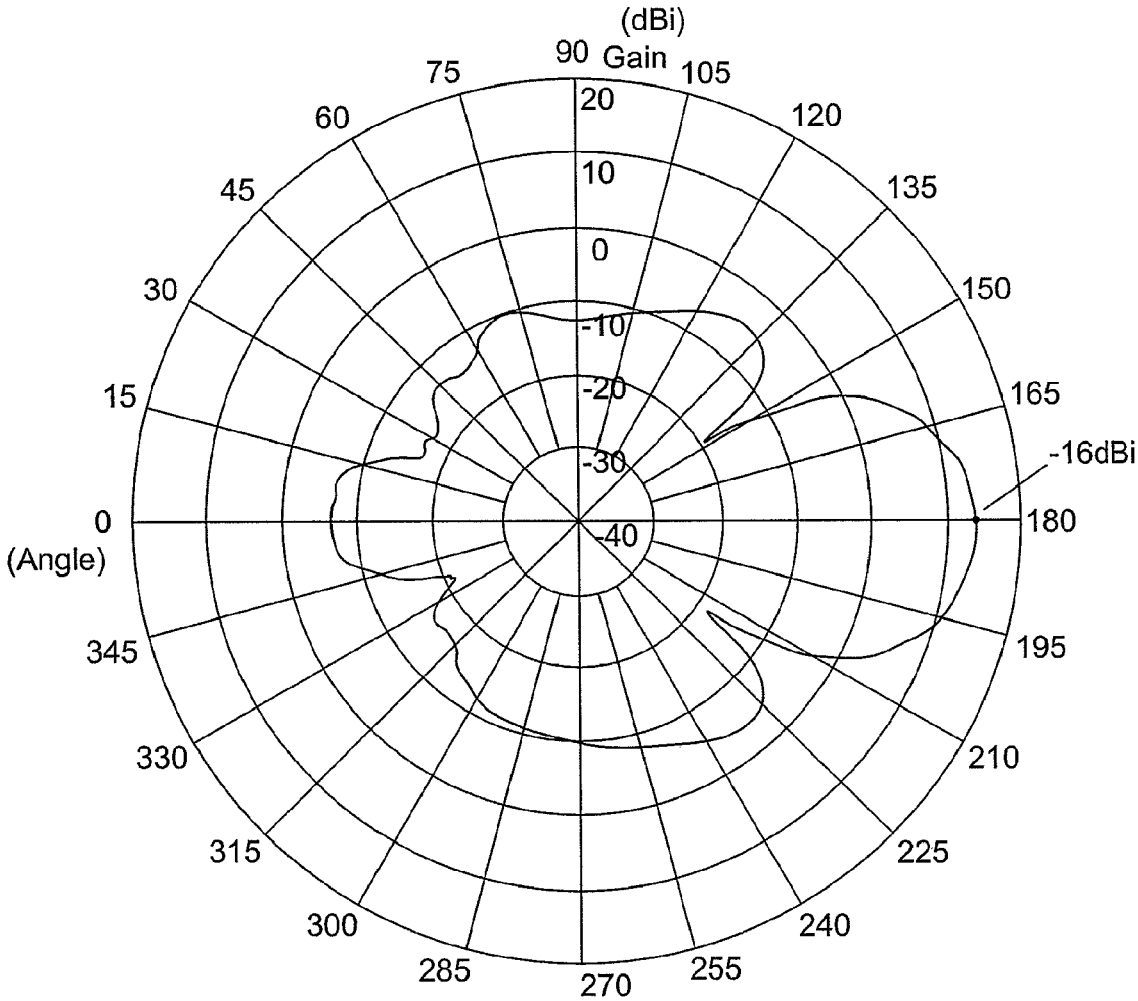

With further reference to FIG. 3, the metallic patches 30 and the feed network 20 of the present invention are located at different levels relative to the top surface of the ground plate 10, and the metallic patches 30 and the feed network 20 are separated by a certain distance.

The conductive fixing posts 50 and the insulated supporting posts 60 are disposed below the metallic patches 30 for separating the metallic patches 30 from the top surface 11 of the ground plate 10 by a certain gap. The conductive screws 40 pass through the metallic patches 30 and fasten the metallic patches 30 on the conductive fixing posts 50. The material of the conductive fixing posts 50 is metal, by connecting the fixing posts 50 and the screws 40 with the metallic patches 30 to make the metallic patches 30 to achieve a ground effect.

As to the screws 40, they can be replaced by any other equivalent fastening elements. The insulated supporting posts 60 are plastic posts that can be engaged with each other up and down have a function of supporting the metallic patches 30.

Furthermore, the level of the metallic patches 30 relative to the ground plate 10 is higher than that of the feed network 20. The relative distance between the metallic patches 30 and the feed network 20 can be adjusted according to the required conditions, and the relative distance between the metallic patches 30 and the ground plate 10 also can be adjusted according to the required conditions.

Besides, in the present invention, the metallic patches 30 and the feed network 20 are stamped and bent from an integral piece of metal. Through a single piece of metal, the shapes of the metallic patches 30 and the feed work 20 are punched out, then vertical connecting portions 25 are formed by bending disposed between the metallic patches 30 and the feed network 20.

In a preferred embodiment of the present invention, the feed network 20 may be stamped in a form of H-shaped configuration and the paths thereof between the first metallic patch group 30*a* and the second metallic patch group 30*b* may be further formed with a U-shaped path 21 to increase the flexibility thereof. Since the two metallic patches 30 of the first metallic patch group 30*a* are arranged in symmetrical, their excited baseband-mode currents have opposite phases. The U-shaped paths 21 allow the phases of the two metallic patches 30 being different from each other by 180 degrees. Therefore, the baseband-mode currents of the two metallic patches 30 are accordingly adjusted to be the same phases by the U-shaped paths 21 to improve the gain of the antenna.

Moreover, when the excited baseband-mode currents of the metallic patches 30 are adjusted to have the same phases, their intercross polarization currents are effectively restrained by each other. The reduction of the intercross polarization currents is also helpful to increase the gain of the antenna.

The vertical connecting portions 25 along with the metallic patches 30 and the feed network 20 are belonging to a same piece of metal plate, therefore it can secure the electrical connection between the metallic patches 30 and the feed network 20.

The feed coaxial cable 70 is mounted on the bottom surface 12 of the ground plate 10 and electrically connected with the feed network 20 so as to feed the signals.

With reference to FIG. 1, when the antenna in accordance with the present invention is operated at the bandwidth S1 from 3.3 GHz to 3.8 GHz, the return loss is higher than 20 dB. The bandwidth S1 can be applied to Wimax requiring the operating frequency of 3.5 GHz.

With reference to FIGS. 5A to 5F, the return loss characteristics of the antenna are measured when the antenna is operated at different frequencies from 3.3 GHz to 3.8 GHz. The peak gains at different operating frequencies are all higher than 15.0 dB and even reach 16.0 dB. With the antenna configuration of the present invention, the interference to the radiation patterns is effectively mitigated.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna comprising:

a ground plate having a top surface, a bottom surface and two opposite edges;

a feed network being arranged above and spaced apart from the top surface of the ground plate by a first level;

a plurality of metallic patches being arranged in pairs and electrically and integrally interconnected with the feed network and spaced apart from the top surface of the ground plate by a second level higher than the first level, each of the metallic patches having a body with an outer edge from which an inclined wing upwardly and outwardly extends toward one of the opposite edges of the ground plate; and a plurality of conductive fixing posts disposed below a part of the metallic patches and electronically connected between the part of the metallic patches and the ground plate;

a plurality of insulated supporting posts disposed below the metallic patches for supporting the metallic patches; and a plurality of fastening elements securing the metallic patches onto the conductive fixing posts;

the metallic patches and the feed network being integrally formed by bending a single piece of metal plate, and the metallic patches and the feed network are located at different levels relative to the top surface of the ground plate.

2. The antenna as claimed in claim 1, wherein an angle between the inclined wing of each metallic patch and the ground plate is within a range from 45 to 90 degrees.

3. The antenna as claimed in claim 2 wherein the two inclined wings of the metallic patches in pair outwardly extend toward the opposite edges of the ground plate respectively.

4. The antenna as claimed in claim 2, wherein the insulated supporting posts are made of plastic material and engaged with each other up and down to support metallic patches.

5. The antenna as claimed in claim 1, wherein the two inclined wings of the metallic patches in pair outwardly extend toward the opposite edges of the ground plate respectively.

6. The antenna as claimed in claim 1, wherein a vertical connecting portion is integrally formed and connected between each of the metallic patches and the feed network.

7. The antenna as claimed in claim 1, wherein a feed coaxial cable is mounted at the bottom surface of the ground plate and electronically connected with the feed network.

8. The antenna as claimed in claim 1, wherein the conductive fixing posts and the fastening elements are made of metal, by connecting the conductive fixing posts and the fastening elements with the metallic patches to make the metallic patches to achieve a ground effect.

9. The antenna as claimed in claim 1, wherein the feed network is formed in an H-shaped configuration to interconnect to the metallic patches.

10. The antenna as claimed in claim 9, wherein the feed network comprises U-shaped paths being connected between two different pairs of the metallic patches.

* * * * *